US008936064B1

(12) United States Patent
Diaz

(10) Patent No.: US 8,936,064 B1
(45) Date of Patent: Jan. 20, 2015

(54) TROLLEY LOCK FOR A GARAGE DOOR OPENER

(71) Applicant: Jerry Diaz, Rio Grande, PR (US)

(72) Inventor: Jerry Diaz, Rio Grande, PR (US)

( * ) Notice: Subject to any disclaimer, the term of this patent is extended or adjusted under 35 U.S.C. 154(b) by 0 days.

(21) Appl. No.: 13/895,174

(22) Filed: May 15, 2013

Related U.S. Application Data

(60) Provisional application No. 61/647,006, filed on May 15, 2012.

(51) Int. Cl.
*E05D 15/16* (2006.01)
*E05B 9/08* (2006.01)

(52) U.S. Cl.
CPC . *E05B 9/08* (2013.01); *Y10S 292/36* (2013.01)
USPC ..... 160/201; 292/DIG. 36

(58) Field of Classification Search
USPC ..... 160/201, 188, 189; 296/DIG. 36; 292/DIG. 36
See application file for complete search history.

(56) References Cited

U.S. PATENT DOCUMENTS

| | | | | |
|---|---|---|---|---|
| 4,018,005 | A * | 4/1977 | Harris | 49/199 |
| 4,813,305 | A * | 3/1989 | Dilich | 74/581 |
| 5,001,861 | A * | 3/1991 | Hahn | 49/280 |
| 5,188,163 | A * | 2/1993 | Schwartzengraber et al. | 160/229.1 |
| 6,273,174 | B1 | 8/2001 | Singleton | |
| 7,665,504 | B2 * | 2/2010 | Schulze | 160/201 |
| 2012/0019011 | A1 | 1/2012 | Laborde | |
| 2012/0043030 | A1 * | 2/2012 | Shepherd et al. | 160/188 |
| 2012/0138240 | A1 * | 6/2012 | Womacks | 160/32 |

OTHER PUBLICATIONS

First Watch—SecureShield Installation Instructions, 2011.
Garage Guard Pro—Anti Theft Device, 2011. http://www.garageguardpro.com.

* cited by examiner

*Primary Examiner* — David Purol
(74) *Attorney, Agent, or Firm* — Hoglund & Pamias, PSC; Roberto J. Rios

(57) ABSTRACT

The invention is a security trolley lock for garage door openers. The trolley lock is a "U-shaped" element that removably attaches to a garage door trolley for preventing lateral access to the release lever of a garage door opener system. The trolley lock has a pass-through opening for allowing attachment of said trolley to a garage door trolley and another pass-through opening for receiving a lock means preventing unauthorized actuation of the release lever.

2 Claims, 3 Drawing Sheets

TROLLEY LOCK FOR A GARAGE DOOR OPENER

BACKGROUND OF THE INVENTION

Garage doors are commonly used in modern homes creating a safety concern. A burglar gains unauthorized access to a home by simply rolling the garage door upward, using its own tracks and rollers making the unauthorized access easier. There have been attempts in the past to make the garage door more secure by inserting a locking pin arrangement into the trackway to prevent the garage door from being open. In addition, there exists the possibility that the garage door opener is activated with the locking pin engaged damaging the entire system. However, this type of locking arrangements while simple might become a hazard that can prevent opening the garage door when needed. Thus, garage doors with such locking arrangements also include a release lever to allow the door to be manually opened. This release levers are generally provided near the garage door itself, and are typically operated by simply pulling a cord, which dangles beneath the release lever.

However, these release mechanisms have created a security breach. Many garage doors close leaving a small space immediately above the door, between the doorframe and uppermost door section. This space is often covered with a rubber gasket. However, this space is often large enough to allow a thin item such as a coat hanger to be inserted into the garage from outside. Accordingly, it is quite possible for an unauthorized person to stand outside of the garage, reach into the garage with coat hanger, and operate the garage door opener release mechanism.

Thus, what is needed is a cost-effective apparatus that prevents unauthorized access and actuation of the garage door release levers and that facilitates ease of installation and replacement.

SUMMARY OF THE INVENTION

The present invention is a security trolley lock for garage door openers.

According to an aspect of the present invention, the trolley lock is a "U-shaped" element that removably attaches to a garage door trolley for preventing lateral access to the release lever of a garage door opener system.

According to another aspect of the invention, the trolley lock has a pass-through opening for allowing attachment of said trolley to a garage door trolley.

According to still another aspect of the invention, the trolley lock has another pass-through opening for receiving a lock means preventing unauthorized actuation of the release lever.

BRIEF DESCRIPTION OF THE DRAWINGS

Further features and advantages of the invention will become apparent from the following detailed description taken in conjunction with the accompanying figures showing illustrative embodiments of the invention, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

Figure 1:
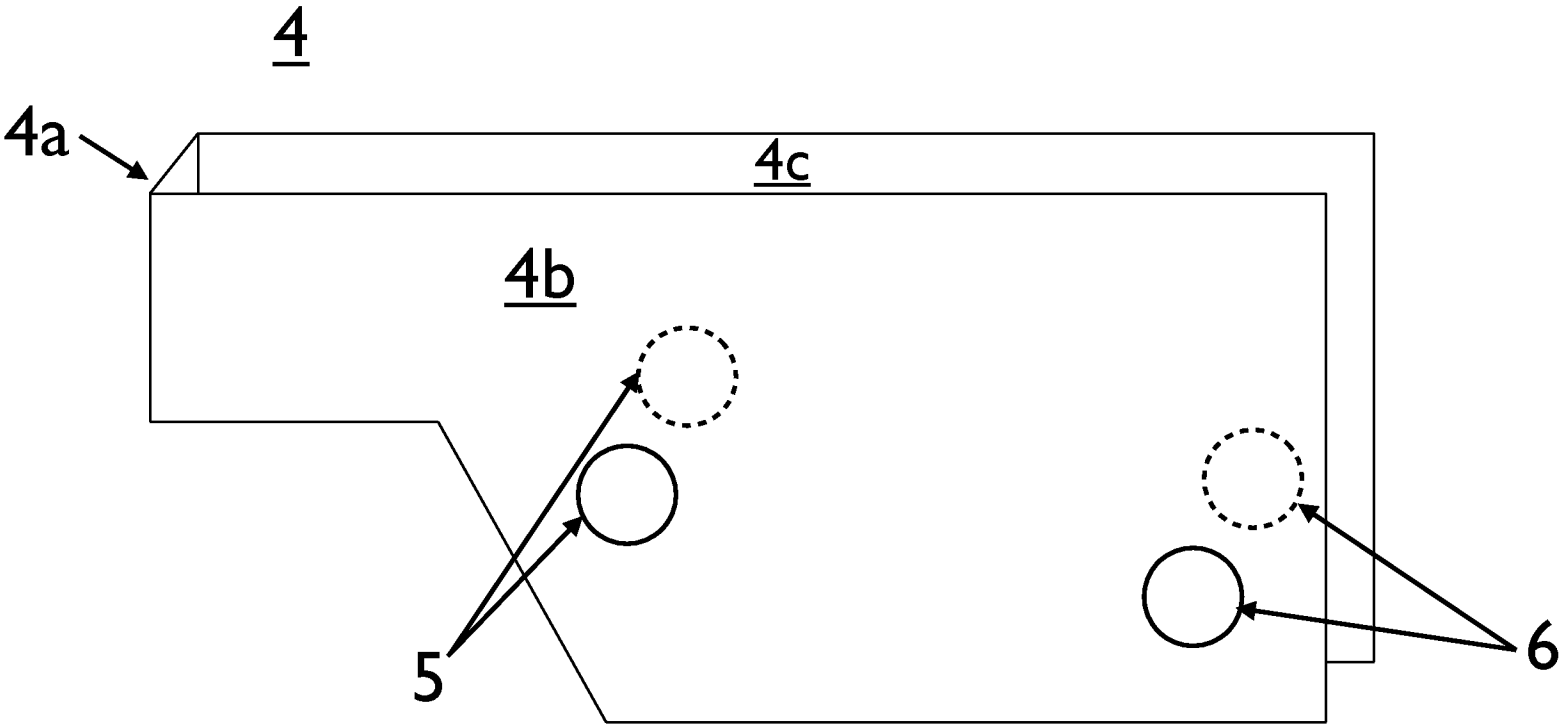
FIG. 1 shows a trolley lock according to the present invention.

The trolley lock of the present invention is a simple yet convenient and secure solution that overcomes the shortcomings of the prior art and provides homeowners with peace of mind. The trolley lock 4 is a metallic, "U" shaped element comprising two parallel plates comprising walls 4*b* and 4*c*, respectively integrally joined by a smaller perpendicular plate comprising wall 4*a* as shown in FIG. 1.

Figure 2:
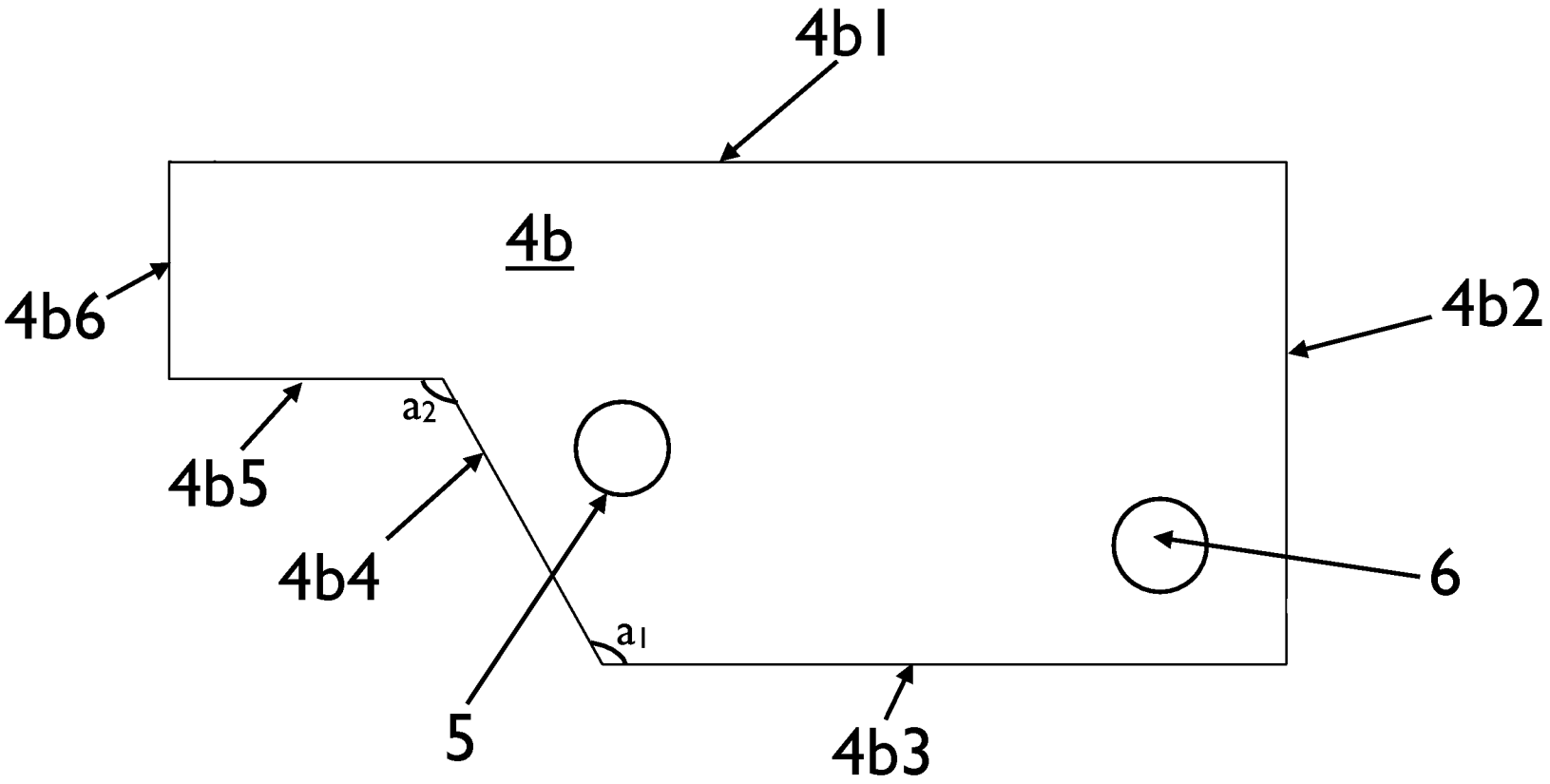
FIG. 2 shows a plate wall surface of a trolley lock according to the present invention.
Figure 3:
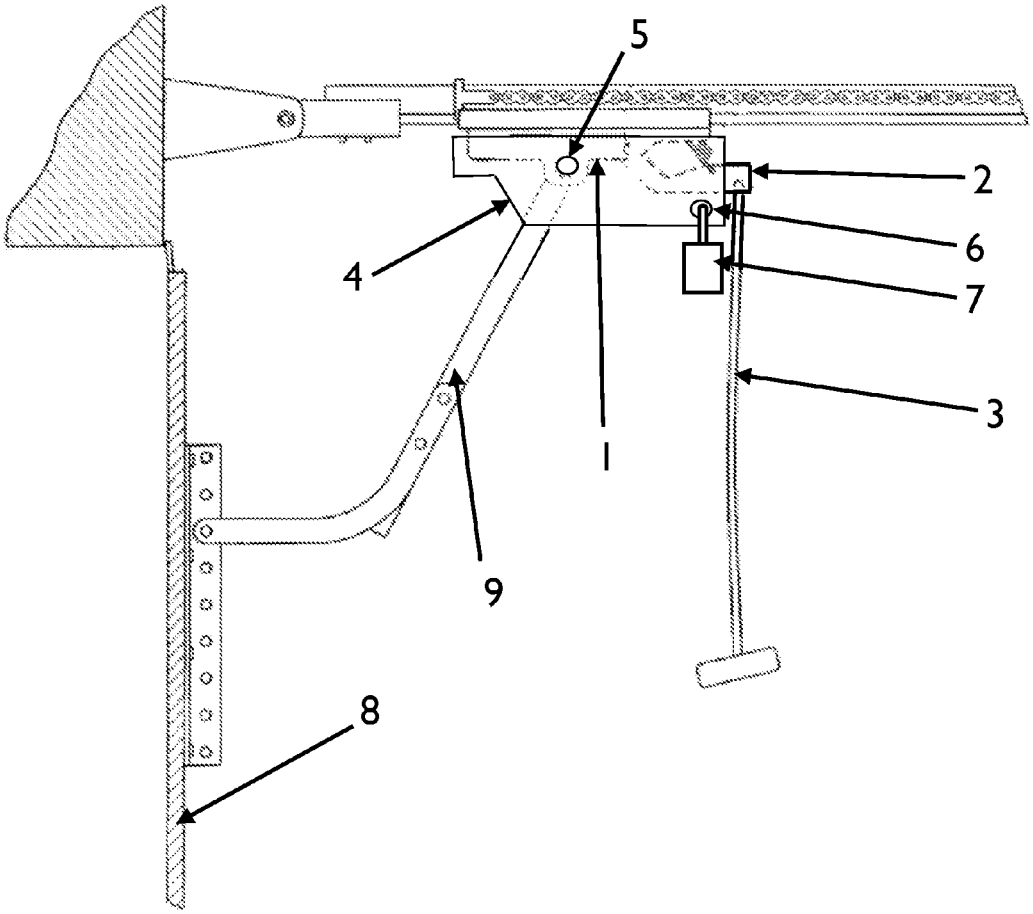
FIG. 3 illustrates a trolley lock used on a garage door opener system according to the present invention.

FIG. 2 shows one plate wall surface 4*b* comprising a straight upper periphery border 4*b*1, a lateral straight periphery border 4*b*2 positioned at a 90° angle with respect to said upper periphery border 4*b*1, a first straight lower periphery border 4*b*3 formed at a 90° angle with respect to said lateral straight periphery border 4*b*2 and parallel to said straight upper periphery border 4*b*1, a second straight lower periphery border 4*b*4 formed at an angle $90° < a_1 < 180°$ with respect to said first straight lower periphery border 4*b*3, a third straight lower periphery border 4*b*5 formed at an angle $90° < a_2 < 180°$ with respect to said second straight lower periphery border 4*b*4 and parallel to said straight upper periphery border 4*b*1 and a lateral straight periphery border 4*b*6 positioned at a 90° angle with respect to said upper periphery border 4*b*1 and said third straight lower periphery border 4*b*5, respectively. The length of said lateral straight periphery border 4*b*6 is smaller than the length of said lateral straight periphery border 4*b*2. Pass-through apertures 5 and 6 are coaxially provided on each wall 4*b* and 4*c*. Specifically, pass-through apertures 5 is provided as a means to removably attach the trolley lock of the present invention to a garage door trolley and pass-through apertures 6 is provided to allow insertion a stop means such as but not limited to a padlock for preventing movement of a garage door release lever. The pass-through aperture 6 is positioned on said plate wall surface 4*b* at a location below the garage door release lever 2 when said trolley lock is attached to the garage door trolley as shown in FIG. 3. Positioning pass-through aperture 6 in such a way is critical for proper operation and removability of the invention. Plate wall surface 4*c* will have the same construction and requirements as plate wall surface 4*b*.

As shown in FIG. 3, trolley lock 4 allows a homeowner to add a padlock 7 and preventing unauthorized disconnection of the garage door from the automatic opener so that the door can be manually open. In operation, a homeowner will attach the trolley lock 4 to the trolley 1 of the garage door opener by changing a cutter ping that holds the arm 9 extending to the garage door 8, for a padlock or any other removable element. There will also be another aperture 6 to place another padlock 7 that wouldn't permit the system to be released without removing the padlock 7.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

I claim:

1. A security trolley lock that prevents unauthorized accessing and actuating a release lever of a garage door opener system, said trolley lock comprising:

a first plate, a second plate parallel to said first plate and a third plate perpendicular to and connecting said first plate to said second plate defining an interior empty space for receiving within said garage door release lever, said first and second plates extend alongside the release lever preventing access to the release lever from the sides;

each of said first and second plates comprises a straight upper periphery border, a first lateral straight periphery border positioned at a 90° angle with respect to said upper periphery border, a first straight lower periphery border formed at a 90° angle with respect to said first lateral straight periphery border and parallel to said straight upper periphery border, a second straight lower periphery border formed at a first angle with respect to said first straight lower periphery border, a third straight lower periphery border formed at a second angle with respect to said second straight lower periphery border and parallel to said straight upper periphery border and a second lateral straight periphery positioned at a 90° angle with respect to said upper periphery border and said third straight lower periphery border and parallel to said first lateral straight periphery border, wherein the length of said second lateral straight periphery border is smaller than the length of said first lateral straight periphery border, a first pass-through aperture for receiving an attaching means removably attaching the trolley lock to a garage door trolley and a second pass-through aperture selectively positioned on said plate at a location below a garage door release lever when said trolley lock is attached to the garage door trolley; and said third plate is connected to the second lateral straight periphery border of said first plate and to the second lateral straight periphery border of said second plate forming a "U-shaped" trolley lock having at least an opening at a bottom portion of said trolley lock defined by: a lower periphery border of said third plate, the first straight lower periphery border, the second straight lower periphery border and the third straight lower periphery border of both said first and second plates providing unobstructed access to said interior empty space and said release lever.

2. A garage door opener system comprising the security trolley lock of claim 1.

* * * * *